US008072845B2

(12) United States Patent
Someya

(10) Patent No.: US 8,072,845 B2
(45) Date of Patent: Dec. 6, 2011

(54) ELECTRIC WAVE RECEIVING APPARATUS AND ELECTRIC WAVE CLOCK

(75) Inventor: Kaoru Someya, Kiyose (JP)

(73) Assignee: Casio Computer Co., Ltd., Tokyo (JP)

( * ) Notice: Subject to any disclaimer, the term of this patent is extended or adjusted under 35 U.S.C. 154(b) by 106 days.

(21) Appl. No.: 12/400,945

(22) Filed: Mar. 10, 2009

(65) Prior Publication Data

US 2009/0231962 A1 Sep. 17, 2009

(30) Foreign Application Priority Data

Mar. 11, 2008 (JP) ..... 2008-060981

(51) Int. Cl.
*G04C 11/02* (2006.01)

(52) U.S. Cl. ..... 368/47

(58) Field of Classification Search ..... 368/47, 368/46

See application file for complete search history.

(56) References Cited

U.S. PATENT DOCUMENTS 4,970,609 A * 11/1990 Cunningham et al. ..... 360/51
5,537,101 A * 7/1996 Nakajima et al. ..... 340/825.21
5,668,915 A * 9/1997 Baik et al. ..... 386/46
6,587,398 B1 * 7/2003 Mock et al. ..... 368/21
6,871,312 B2 * 3/2005 Hatley ..... 714/752
7,075,859 B2 * 7/2006 Miyahara et al. ..... 368/47
7,373,175 B2 * 5/2008 Carter et al. ..... 455/561
2004/0228219 A1 * 11/2004 Miyahara et al. ..... 368/47
2006/0067166 A1 * 3/2006 Murata et al. ..... 368/47
2007/0177690 A1 8/2007 Watanabe et al.
2007/0230285 A1 * 10/2007 Nakagawa ..... 368/47
2008/0198697 A1 * 8/2008 Tsuji et al. ..... 368/34

FOREIGN PATENT DOCUMENTS

JP 2006-184198 A 7/2006

OTHER PUBLICATIONS

Japanese Office Action dated Mar. 2, 2010 and English translation thereof in counterpart Japanese Application No. 2008-060981.

* cited by examiner

*Primary Examiner* — Sean Kayes
(74) *Attorney, Agent, or Firm* — Holtz, Holtz, Goodman & Chick, PC

(57) ABSTRACT

An electric wave receiving apparatus obtains the received data in a partial period, and judges the timing of the received data in which partial data has been received by comparing the received data with the partial data. Thereby, the electric wave receiving apparatus performs correction of the second data of timing data.

2 Claims, 7 Drawing Sheets

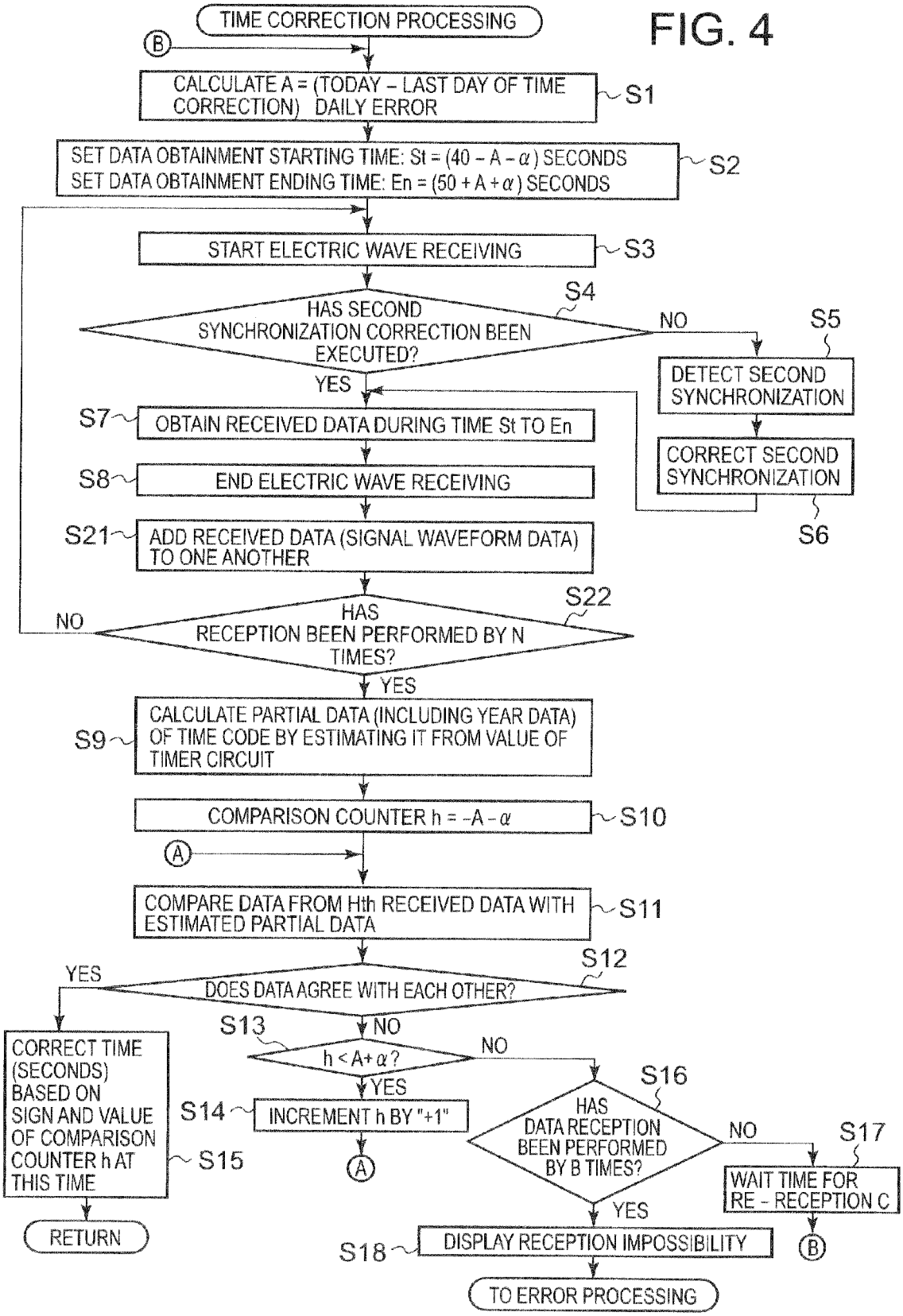
FIG. 4
TIME CORRECTION PROCESSING
B
CALCULATE A = (TODAY – LAST DAY OF TIME CORRECTION) DAILY ERROR
S1
SET DATA OBTAINMENT STARTING TIME: St = (40 – A – α) SECONDS
SET DATA OBTAINMENT ENDING TIME: En = (50 + A + α) SECONDS
S2
START ELECTRIC WAVE RECEIVING
S3
S4
HAS SECOND SYNCHRONIZATION CORRECTION BEEN EXECUTED?
NO
S5
DETECT SECOND SYNCHRONIZATION
CORRECT SECOND SYNCHRONIZATION
S6
YES
S7
OBTAIN RECEIVED DATA DURING TIME St TO En
S8
END ELECTRIC WAVE RECEIVING
S21
ADD RECEIVED DATA (SIGNAL WAVEFORM DATA) TO ONE ANOTHER
S22
HAS RECEPTION BEEN PERFORMED BY N TIMES?
NO
YES
S9
CALCULATE PARTIAL DATA (INCLUDING YEAR DATA) OF TIME CODE BY ESTIMATING IT FROM VALUE OF TIMER CIRCUIT
COMPARISON COUNTER h = -A - α
S10
A
COMPARE DATA FROM Hth RECEIVED DATA WITH ESTIMATED PARTIAL DATA
S11
S12
DOES DATA AGREE WITH EACH OTHER?
YES
NO
CORRECT TIME (SECONDS) BASED ON SIGN AND VALUE OF COMPARISON COUNTER h AT THIS TIME
S15
RETURN
S13
h < A+ α ?
NO
YES
S14
INCREMENT h BY "+1"
A
S16
HAS DATA RECEPTION BEEN PERFORMED BY B TIMES?
NO
S17
WAIT TIME FOR RE - RECEPTION C
B
YES
S18
DISPLAY RECEPTION IMPOSSIBILITY
TO ERROR PROCESSING

FIG. 5

| MINUTE | MINUTE DISPLAY DATA TIME | | | | | | | | | | |
|---|---|---|---|---|---|---|---|---|---|---|---|
| | 0 SECOND | 1 SECOND | 2 SECONDS | 3 SECONDS | 4 SECONDS | 5 SECONDS | 6 SECONDS | 7 SECONDS | 8 SECONDS | 9 SECONDS | |
| 0 | M | 0 | 0 | 0 | 0 | 0 | 0 | 0 | 0 | P | |
| 1 | M | 0 | 0 | 0 | 0 | 0 | 0 | 0 | 1 | P | |
| 2 | M | 0 | 0 | 0 | 0 | 0 | 0 | 1 | 0 | P | |
| 3 | M | 0 | 0 | 0 | 0 | 0 | 0 | 1 | 1 | P | |
| 4 | M | 0 | 0 | 0 | 0 | 0 | 1 | 0 | 0 | P | |
| 5 | M | 0 | 0 | 0 | 0 | 0 | 1 | 0 | 1 | P | |
| 6 | M | 0 | 0 | 0 | 0 | 0 | 1 | 1 | 0 | P | Y1 |
| 7 | M | 0 | 0 | 0 | 0 | 0 | 1 | 1 | 1 | P | |
| 8 | M | 0 | 0 | 0 | 0 | 1 | 0 | 0 | 0 | P | |
| 9 | M | 0 | 0 | 0 | 0 | 1 | 0 | 0 | 1 | P | |
| 10 | M | 0 | 0 | 1 | 0 | 0 | 0 | 0 | 0 | P | |
| 11 | M | 0 | 0 | 1 | 0 | 0 | 0 | 0 | 1 | P | |
| 12 | M | 0 | 0 | 1 | 0 | 0 | 0 | 1 | 0 | P | |
| 13 | M | 0 | 0 | 1 | 0 | 0 | 0 | 1 | 1 | P | |
| 14 | M | 0 | 0 | 1 | 0 | 0 | 1 | 0 | 0 | P | |
| 15 | M | 0 | 0 | 1 | 0 | 0 | 1 | 0 | 1 | P | |
| 16 | M | 0 | 0 | 1 | 0 | 0 | 1 | 1 | 0 | P | Y2 |
| 17 | M | 0 | 0 | 1 | 0 | 0 | 1 | 1 | 1 | P | |
| 18 | M | 0 | 0 | 1 | 0 | 1 | 0 | 0 | 0 | P | |
| 19 | M | 0 | 0 | 1 | 0 | 1 | 0 | 0 | 1 | P | |
| 20 | M | 0 | 1 | 0 | 0 | 0 | 0 | 0 | 0 | P | |
| 21 | M | 0 | 1 | 0 | 0 | 0 | 0 | 0 | 1 | P | |
| 22 | M | 0 | 1 | 0 | 0 | 0 | 0 | 1 | 0 | P | |
| 23 | M | 0 | 1 | 0 | 0 | 0 | 0 | 1 | 1 | P | |
| 24 | M | 0 | 1 | 0 | 0 | 0 | 1 | 0 | 0 | P | |
| 25 | M | 0 | 1 | 0 | 0 | 0 | 1 | 0 | 1 | P | |
| 26 | M | 0 | 1 | 0 | 0 | 0 | 1 | 1 | 0 | P | Y3 |
| 27 | M | 0 | 1 | 0 | 0 | 0 | 1 | 1 | 1 | P | |
| 28 | M | 0 | 1 | 0 | 0 | 1 | 0 | 0 | 0 | P | |
| 29 | M | 0 | 1 | 0 | 0 | 1 | 0 | 0 | 1 | P | |
| 30 | M | 0 | 1 | 1 | 0 | 0 | 0 | 0 | 0 | P | |
| ⋮ | | | | | | | | | | | |
| 50 | M | 1 | 1 | 0 | 0 | 0 | 0 | 0 | 0 | P | |
| 51 | M | 1 | 1 | 0 | 0 | 0 | 0 | 0 | 1 | P | |
| 52 | M | 1 | 1 | 0 | 0 | 0 | 0 | 1 | 0 | P | |
| 53 | M | 1 | 1 | 0 | 0 | 0 | 0 | 1 | 1 | P | |
| 54 | M | 1 | 1 | 0 | 0 | 0 | 1 | 0 | 0 | P | |
| 55 | M | 1 | 1 | 0 | 0 | 0 | 1 | 0 | 1 | P | |
| 56 | M | 1 | 1 | 0 | 0 | 0 | 1 | 1 | 0 | P | Y10 |
| 57 | M | 1 | 1 | 0 | 0 | 0 | 1 | 1 | 1 | P | |
| 58 | M | 1 | 1 | 0 | 0 | 1 | 0 | 0 | 0 | P | |
| 59 | M | 1 | 1 | 0 | 0 | 1 | 0 | 0 | 1 | P | |

ELECTRIC WAVE RECEIVING APPARATUS AND ELECTRIC WAVE CLOCK

CROSS-REFERENCE TO RELATED APPLICATIONS

This application is based upon and claims the benefit of priority from the prior Japanese Patent Application No. 2008-60981, filed Mar. 11, 2008, the entire contents of which are incorporated herein by reference.

BACKGROUND OF THE INVENTION

1. Field of the Invention

The present invention relates to an electric wave receiving apparatus that receives an electric wave modulated by a time code and an electric wave clock that performs the time correct of an internal clock on the basis of a received time code.

2. Related Art

There has been an electric wave clock for receiving a time code to automatically correct the internal clock of the electric wave clock before. The time code is transmitted as a standard electric wave by performing the amplitude modulation (AM) of a carrier wave of 40 kHz or 60 kHz. As shown in FIG. 6, in the time code, a frame of data is composed of 60 data pulses arranged in each second which data pulses are classified into three kinds that are identified by their pulse widths. Then, for example, the time code in Japan is configured so as to express a "minute" by the partial data from 1 second to 8 seconds, an "hour" by the partial data from 12 seconds to 18 seconds, a "total days" by the partial data from 22 seconds to 33 seconds, and a "year" by the partial data from 41 seconds to 48 seconds.

Conventional electric wave clocks have generally received the time code during the whole period of one frame or a plurality of frames of the time code to perform time setting and time corrections (see, for example, US 2007/0177690 A1).

The reception processing of the standard electric wave consumes comparatively large electric power. In particular, in a wrist watch driven by a small-sized battery, the electric power consumption is the level of consumption that cannot be treated lightly. Consequently, there is the problem of shortening a total time during which electric power is consumed by the electric wave receiving processing at the time of receiving the time code to perform a time correction.

Moreover, the standard electric wave sometimes cannot be received as a neat signal owing to attenuation in an office building, the mixture of external noises, and the like. Consequently, there is also the problem of judging the time code accurately to enable a correct time correction even under such a bad electric wave condition.

SUMMARY OF THE INVENTION

The present invention is directed to provide an electric wave receiving apparatus capable of receiving a time code necessary for a time correction with little electric power consumption and an electric wave clock capable of performing a time correction with little electric power consumption.

An aspect of the present invention is an electric wave receiving apparatus comprising: a reception section for receiving an electric wave and demodulating the received electric wave to obtain a time code; a control section for obtaining received data from the reception section in a partial period supposed to include partial data in a specific range of the time code in a transmission period of one frame of the time code; a comparison section for making a comparison between the received data obtained in the partial period and the partial data in the specific range supposed to be received in the partial period; and a judgment section for judging in which timing in the partial period the partial data has been received by the comparison of the comparison section.

Moreover, another aspect of the present invention is an electric wave clock comprising: a reception section for receiving an electric wave and demodulating the received electric wave to obtain a time code; a control section for obtaining received data from the reception section in a partial period supposed to include partial data in a specific range of the time code in a transmission period of one frame of the time code; a comparison section for making a comparison between the received data obtained in the partial period and the partial data in the specific range supposed to be received in the partial period; a judgment section for judging in which timing in the partial period the partial data has been received by the comparison of the comparison section; a timer section to time time; and a data correcting section for correcting timing data of the timer section on the basis of the timing judged by the judgment section.

BRIEF DESCRIPTION OF THE DRAWINGS

FIG. 4 is a flow chart showing the procedure of the time correction processing of a second embodiment;

FIG. 5 is a diagram for illustrating an example of a reception frame of minute data to be added in addition processing of received data in the case where partial data in a specific range is set as minute data;

DETAILED DESCRIPTION OF THE PREFERRED EMBODIMENTS

In the following, the preferred embodiments of the present invention will be described in detail with reference to the attached drawings.

First Embodiment

Figure 1:
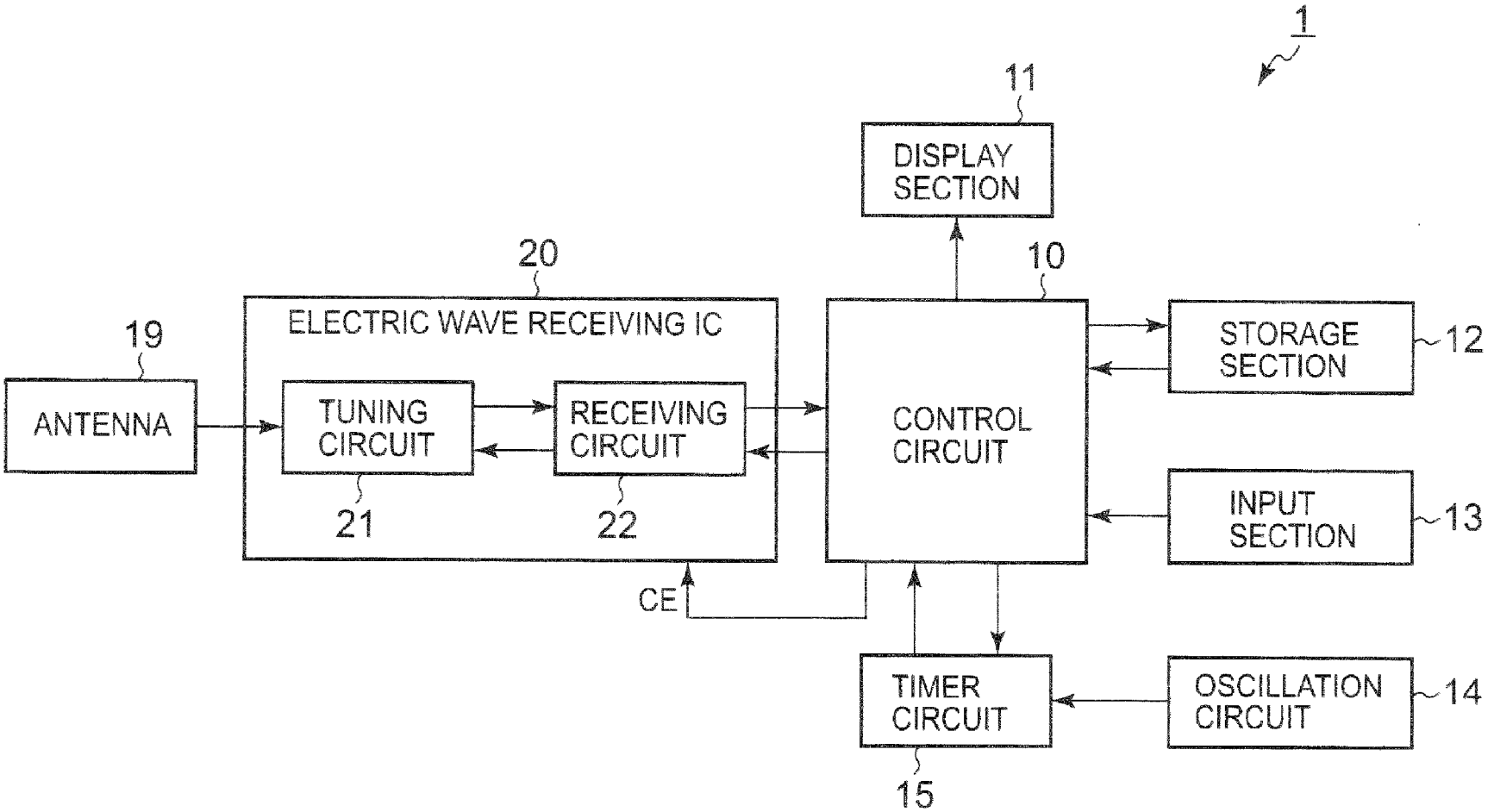
FIG. 1 is a block diagram showing the internal configuration of the electric wave clock of a first embodiment of the present invention.

FIG. 1 is a block diagram showing the internal configuration of the electric wave clock of a first embodiment of the present invention.

The electric wave clock 1 of the first embodiment is, for example, the watch main body of a wrist watch, and has the function of receiving a standard electric wave to perform time corrections automatically on the basis of a time code. The electric wave clock 1 is provided with a display section 11 to perform a time display and the like, a control circuit 10 to perform the overall control of the apparatus, a storage section 12 to store control data, control programs, and the like, an input section 13 to include a plurality of manual operation buttons, a timer circuit 15 to perform the timing of time, an oscillation circuit 14 to supply a predetermined frequency signal to the timer circuit 15, an antenna 19 to receive the standard electric wave, an electric wave receiving IC 20 to receive the standard electric wave and to demodulate the standard wave to obtain the time code, and the like.

The control circuit 10 is composed of, for example, a microcomputer, and is equipped with an AD converter to perform the AD conversion of a received signal transmitted from the electric wave receiving IC 20 to input the converted received signal into the control circuit 10, a central processing unit (CPU) to execute the control programs, a random access memory (RAM) to provide the CPU with a memory space for operation, an I/O circuit to perform input and output with each section, and the like.

The electric wave receiving IC 20 is equipped with a tuning circuit 21 to switch the frequency of a received standard electric wave, a receiving circuit 22 to perform electric wave receiving and the demodulation processing of the received electric wave to obtain the time code, and the like. The tuning circuit 21 includes, for example, tuning capacitors, a switch circuit to switch the connections of the tuning capacitors, and the like, and the channel of the received frequency is switched by switching the connections of the tuning capacitors. The receiving circuit 22 includes an amplifier to amplify the received signal, an automatic gain control circuit to perform gain control, a filter circuit to remove noise components from the received signal, a detector circuit to perform the demodulation of the received electric wave to obtain the time code, and the like.

The electric wave receiving IC 20 is configured to receive an enable signal CE from the control circuit 10 and to operate. The electric wave receiving IC 20 is also configured so that, for example, when the enable signal CE becomes an invalid value and the electric wave receiving IC 20 becomes its non-operating state, the electric wave receiving IC 20 may be intercepted from the supply of the power supply voltage and may suppress its electric power consumption to be low.

Next, the operation of the reception processing of a time code in the electric wave clock 1 of the embodiment will be described.

For example, immediately after battery replacement or when a specific operation input is performed from the outside, the electric wave clock 1 of this embodiment performs electric wave receiving in its normal mode to correct the data of a year, a month, a day, an hour, a minute, and a second. In the normal, mode reception processing, the electric wave clock 1, for example, continuously receives the time code for a plurality of frames, and performs the ascertainment of the existence of data errors in the time code of the whole period, following which the electric wave clock 1 performs the data corrections of the year, month, day, hour, and minute of the timer circuit 15 on the basis of the data content of this time code. Moreover, the electric clock 1 performs the data correction of the Q second point of the timer circuit 15 on the basis of the detection of the frame starting point of the received time code and the data correction of the 0.0 second point of the timer circuit 15 on the basis of the detection of the rising points of the data pulses of the time code.

If the electric wave receiving in the normal mode has succeeded, then the electric clock 1 shifts to a second correcting mode of performing only the correction of the 0 second point on the basis of electric wave receiving from the next time correction processing. The timer circuit 15 only causes small errors, such as a daily error of ±0.5 second or less, depending on the accuracy of the oscillation circuit 14. Consequently, if the corrections of an hour, a minute, and a second have been once performed, then only an error of the degree of ±15 seconds is caused and no discrepancies are caused in the hour and the minute even if no time corrections are performed for the degree of one month after that. Consequently, by setting the time correction processing of the second correcting mode to be performed at every suitable time interval, the value of the timing data of the timer circuit 15 can be kept not to shift from the real time largely. The time correction processing of the second correcting mode is set to be executed at suitable timing, such as every half day or every day.

Figures 2A, 2B, 2C, 2D:
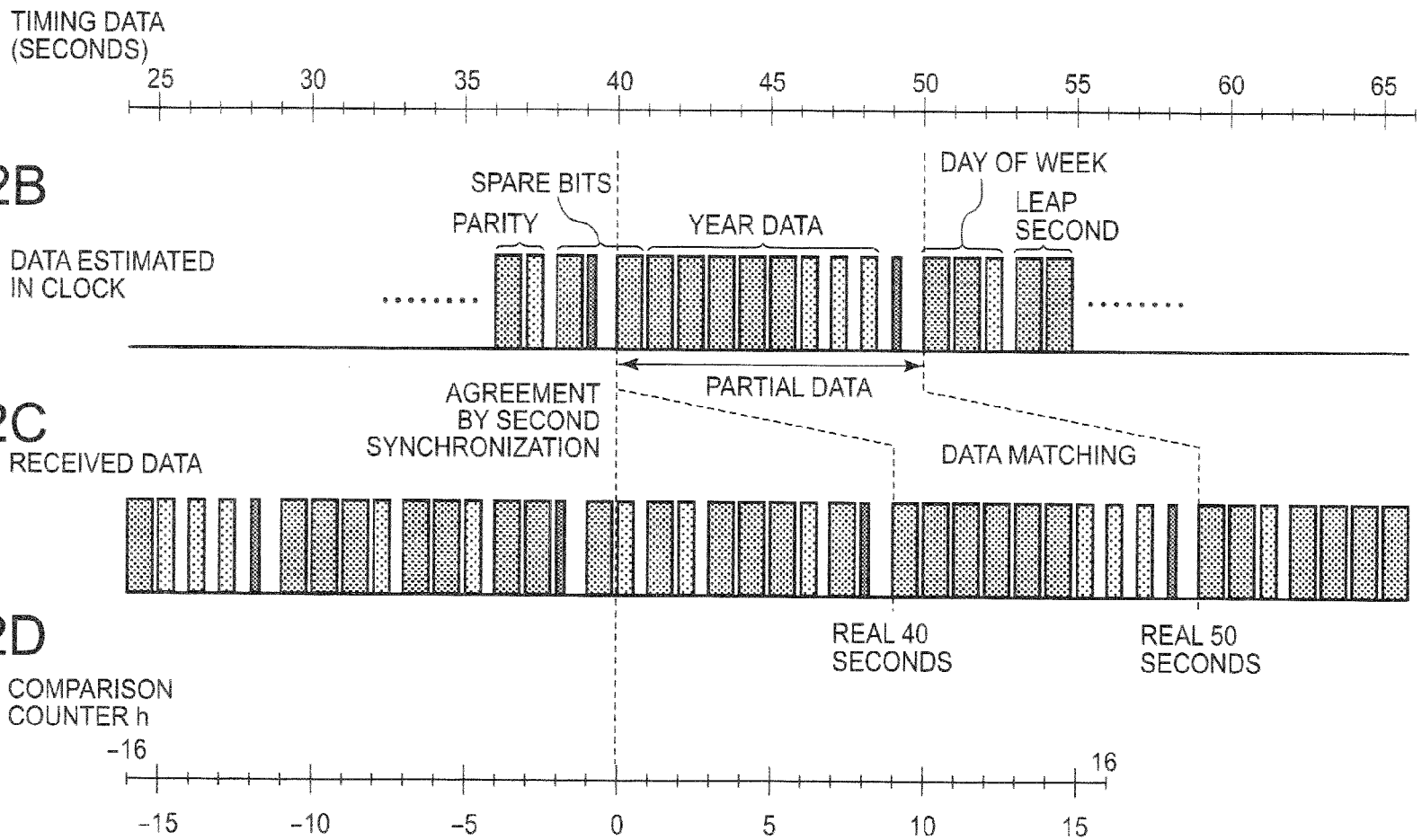
FIG. 2A is a time chart expressing second data counted in a timer circuit.
FIG. 2B is a time chart expressing partial data in a specific range to be used in time correction processing.
FIG. 2C is a time chart expressing received data received in a partial period in a frame.
FIG. 2D is a time chart expressing values of a comparison counter.

FIGS. 2A~2D show time charts expressing the content of each data used in time correction processing. FIG. 2A shows the timing data of seconds of the timer circuit 15; FIG. 2B shows partial data in a specific range estimated by the control circuit 10; FIG. 2C shows received data received in the time correction processing; and FIG. 2D shows the values of a comparison counter h.

In the present embodiment, the time correction processing of the second correcting mode is executed as follows. That is, the control circuit 10 previously selects a piece of partial data D1 in a specific range of the time code in which range the time code does not change so much. In the first embodiment, the data in the range including a piece of year data and a data pulse at each of the positions before and behind the year data (in the range of from a 40 second point to a 50 second point of the time code) is set as the partial data D1 in the specific range. The partial data D1 is the data enabling the estimation of the pattern of the arrangement of data pulses on the basis of the timing data of the timer circuit 15. Accordingly, as shown in FIG. 2B, the control circuit 10 generates the partial data D1 in the specific range by estimating the partial data D1 by the use of the timing data of the timing circuit 15 in the time correction processing.

Moreover, the control circuit 10 obtains received data from the electric wave receiving IC 20 only in a partial period during a period of one frame of the time code in the time correction processing of the second correcting mode. The period in which the received data is obtained is set to the partial period estimated to include the partial data D1 in the specific range mentioned above.

If the timing data of the timer circuit 15 includes no errors here, then the period to be estimated to include the partial data D1 mentioned above is the period of from 40 seconds to 50 seconds of the timing data of the timer circuit 15. However, the timing data shifts from the real time slightly. Furthermore, since the error caused in the timing data is known to be within a daily error of 10.5 second, the maximum error time between the timing data of the timer circuit 15 and the real time can be calculated by integrating the time length from the time point at which the time correction processing has been carried out at the last time to the time point of the time correction processing at this time by the error quantity per unit time.

Accordingly, the period of from 40 seconds to 50 seconds of the timing data of the time circuit 15 and a period obtained by adding the maximum error time of the timer circuit 15 to the former period at each of the positions before and after the former period (or a period obtained by adding a surplus value to the former period) are set as the period to be estimated to include the partial data D1 mentioned above. The control circuit 10 makes the electric wave receiving IC 20 operate in this period to obtain the received data in this period.

The example shown in FIGS. 2A~2D shows the example in which 30 days have elapsed from the time correction processing at the last time to the time correction processing at this time, and the maximum error time of the timing data of the timer circuit 15 is calculated to be 15 seconds in this example. Moreover, the example adds one second to the maximum error time as the surplus value. In this case, the period in which the control circuit 10 obtains the received data is the period of from 14 seconds to 6 seconds (66 seconds) of the timing data of the timer circuit 15.

When the control circuit 10 has obtained the received data of the time code in the aforesaid period, the control circuit 10 subsequently judges in which position of the received data the partial data D1 is included by performing data matching processing. In the example shown in FIGS. 2A~2D, for example, the control circuit 10 shifts the timing position of the estimated partial data D1 by the value of the comparison counter h, and makes the comparison of the partial data D1 with the received data at the shifted position. The control circuit 10, for example, changes the value of the comparison counter h from the minimum value thereof to the maximum value thereof to make such a comparison at each changed value of the comparison counter h. Then, if a pulse arrangement agreeing with that of the partial data D1 is found in the received data by such comparison processing, then the value of the comparison counter h at that time expresses the error quantity of the second data of the timing data of the timer circuit 15.

Accordingly, the second data of the timer circuit 15 is corrected by making the second data of the timer circuit 15 reflect the error quantity, and the timing data of the timer circuit 15 is set to the present time. In the example shown in FIGS. 2A~2D, when the value of the comparison counter h is "9," the pulse arrangement of the partial data D1 and that of the received data agree with each other. Consequently, the timing data of the timer circuit 15 is judged to be too fast by 9 seconds, and the correction of the 0 second point is completed by setting back the value of the timing data by 9 seconds. Incidentally, the correction of the 0.0 second point is separately carried out by performing the processing (second synchronization correction) of detecting the rising point of each data pulse of the time code and setting the count timing of the 0.0 second point of the timer circuit 15 to the rising point at the time of starting the time correction processing in advance.

Incidentally, since in which position of the received data the partial data D1 is included is judged by the data matching processing in the time correction processing of the second correcting mode, the selection of the partial data D1 requires care lest the partial data D1 should be confused with the data in another range at the time of the data matching processing. For example, if the data in the range including a marker pulse M or a position marker pulse P is selected as the partial data D1, then the appearance positions of these pulses M and P are restricted, and it is preferable to make the partial data D1 the data in a range of at least 5 seconds or more. Moreover, if the data in a range not including the marker pulse M and the position marker pulse P is selected as the partial data D1, then it is preferable to select the data in a range for 7 seconds or more as the partial data D1. Moreover, the longer the length of the received data of a comparison object becomes, the more the data having the possibility of being confused with the partial data D1 is included in the received data. Accordingly, it is preferable to restrict the length of the received data to be within a range of being not so much longer than the range in consideration of the maximum error quantity of the timer circuit 15 as described above.

Next, the time correction processing of the second correcting mode described above will be described in detail on the basis of a flow chart.

Figure 3:
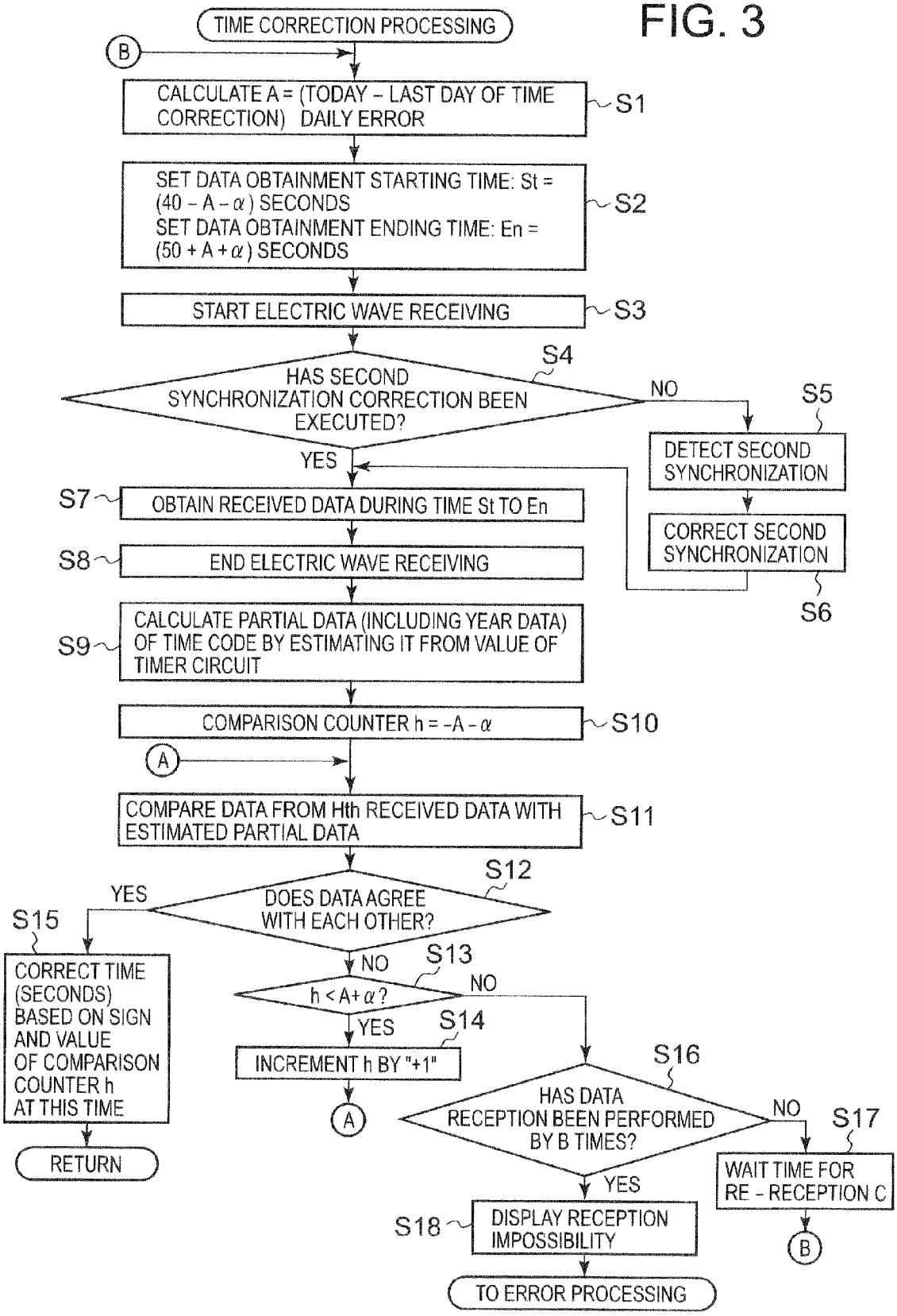
FIG. 3 is a flow chart showing the control procedure of the time correction processing of the first embodiment executed by a control circuit.
Figure 6:
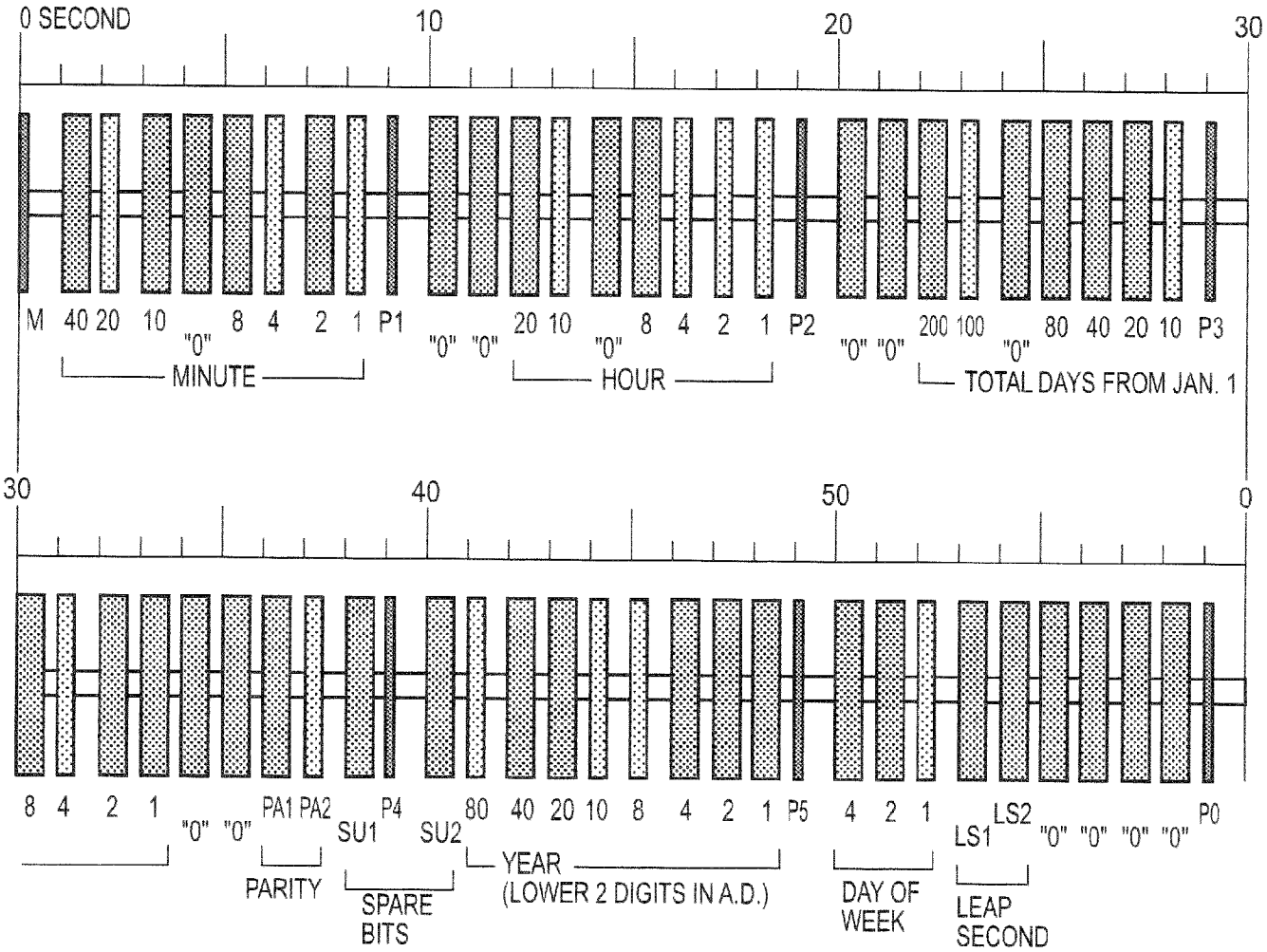
FIG. 6 is a data chart showing an example of a time code.
Figure 7A:
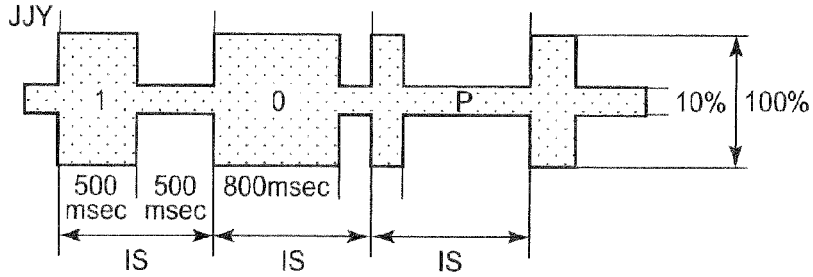
FIGS. 7A, 7B, 7C, 7D, and 7E are waveform diagrams showing examples of data pulses constituting the time codes of various countries.
Figure 7B:
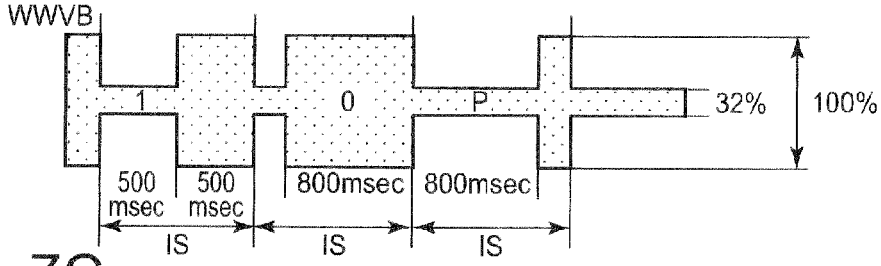
Figure 7C:
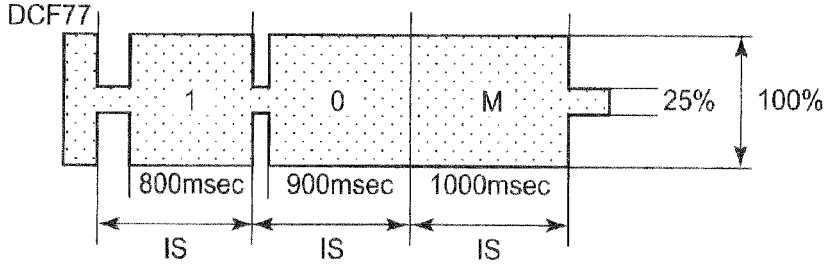
Figure 7D:
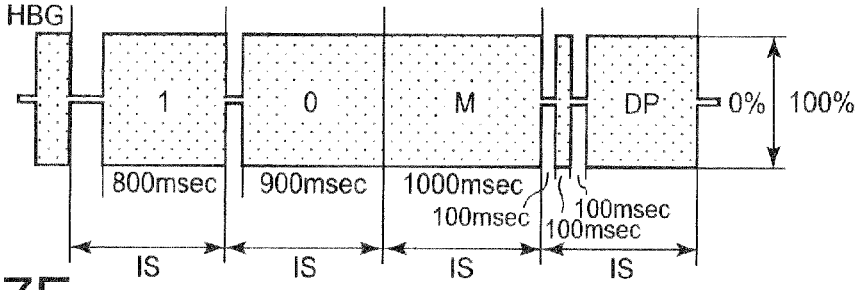
Figure 7E:
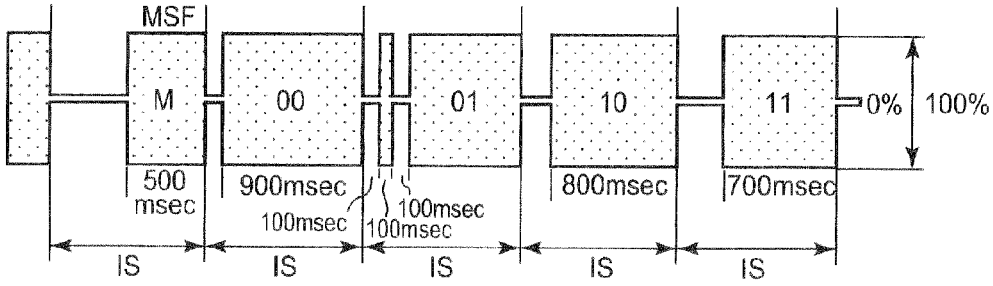

FIG. 3 is a flow chart showing the procedure of the time correction processing of the second correcting mode executed by the control circuit 10.

When it becomes a set time determined in advance, or when a predetermined operation input is performed and the time correction of the second correcting mode is required, the control circuit 10 starts the time correction processing. When the control circuit 10 shifts its processing to the time correction processing, the control circuit 10 first calculates the maximum error time A that can be considered to be caused in the timing data of the timer circuit 15 (Step S1). For example, the control circuit 10 calculates the number of days from the last day on which the time correction processing at the last time was executed until this day, and calculates the value obtained by integrating the number of days with the maximum daily error (for example, 0.5 second) as the maximum error time A. The last day of the execution of the time correction processing can be read out from the storage section 12 by writing the carrying-out day into the storage section 12 by the control circuit 10 after the time correction processing.

Next, the control circuit 10 sets a partial period (of from a data obtainment starting time St to a data obtainment ending time En) in which the control circuit 10 obtains the received data of the time code by means of the aforesaid maximum error time A (Step S2). That is, the control circuit 10 sets the data obtainment starting time St (second) and the data obtainment ending time En (second) by adding the maximum error time A and a surplus value $\alpha$ (for example, 1 second) to the period of from 40 seconds to 50 seconds, in which the partial data D1 is transmitted, at the positions before and after the period.

After the setting of the obtainment period of the received data, the control circuit 10 next outputs an enable signal CE to the electric wave receiving IC 20 to start an electric wave receiving operation (Step S3). Then, the control circuit 10 first ascertains whether the second synchronization correction for setting the 0.0 second point has been executed or not (Step S4) If the second synchronization correction has not been executed yet, then the control circuit 10 receives, for example, a plurality of data pulses in the time code, and detects their rising points (Step S5) to correct the value of the timing data at the 0.0 second point of the timer circuit 15 on the basis of the detection (Step S5) Then, the control circuit 10 shifts the time correction processing to the next step at which the control circuit 10 obtains received data. On the other hand, if the second synchronization correction has been executed, then the control circuit 10 shifts the time correction processing to the next step, at which the control circuit 10 obtains the received data, as it is.

When the time correction processing has shifted to the next step, the control circuit 10 first obtains the received data in the data obtainment period (of from the time St to the time En), set by the processing at Step S2, from the electric wave receiving IC 20 by inputting the received data into the control circuit 10 (Step S7). Then, when the control circuit 10 has obtained the received data, the control circuit 10 makes the enable signal CE an invalid value to stop the operation of the electric wave receiving IC 20 (Step S8).

Next, the control circuit 10 generates the partial data D1 for the comparison with the received data by estimating the partial data D1 from the timing data of the timer circuit 15 (Step S9). That is, since the timer circuit 15 has counted the value of the present year, the control circuit 10 operates the pulse arrangement of the year data of the time code from the value of the year, and generates the pulse arrangement of the partial data D1 on the basis of the pulse arrangement of the year data.

Next, the control circuit 10 initializes the value of the comparison counter h in order to compare the generated pulse arrangement of the partial data D1 with the pulse arrangement of the received data (Step S10). In the present embodiment, since the example of performing the data comparison by shifting the pulses from the head of the received data second by second in order is shown, although the present invention is not restricted to the method, "−A−α" is set as the initial value of the comparison counter h.

Next, the control circuit 10 repeats the loop processing from Step S11 to Step S14 to judge the position of the received data having the pulse arrangement same as that of the partial data D1. That is, the control circuit 10 sets the 40 second point of the timer circuit 15 as a "0" point, and compares the data having a starting point of the value of the comparison counter h in the received data with the partial data D1 (Step S11). Then, the control circuit 10 judges whether the comparison result indicates the agreement of both the data and the partial data D1 or not (Step S12). If the pieces of data do not agree with each other, then the control circuit 10 ascertains whether the value of the comparison counter h has reached the last value or not (Step S13) If the value does not reach the last value, then the control circuit 10 adds "1" to the value of the comparison counter h, and returns the time correction processing to the comparison processing at Step S11 again.

Then, since such loop processing from Step S11 to Step S14 enables the control circuit 10 to judge the degree of the discrepancy of the timing at which the partial data D1 has been received on the basis of the value of the comparison counter h if the pulse arrangement of the partial data D1 and the pulse arrangement of a certain position of the received data agree with each other, the control circuit 10 moves the time correction processing to the side of YES in the judgment processing at Step S12, and the control circuit 10 corrects the second timing data value of the time circuit 15 on the basis of the sign and value of the comparison counter h (Step S15). Hereby, the timing data of the timer circuit 15 is set to the present time.

As described above, in the example shown in FIGS. 2A~2D, the control circuit 10 performs the comparisons of the partial data D1 with the received data from the value "−16" of the comparison counter h in order, and the pulse arrangement of the partial data D1 agrees with that of the received data when the value of the comparison counter h is "9." Consequently, the control circuit 10 judges that the timing data of the timer circuit 15 is too fast by 9 seconds, and sets back the second value of the timing data of the timer circuit 15 by 9 seconds to set the second value to the present time.

Then, when the control circuit 10 has corrected the timing data of the timer circuit 15 as described above, the control circuit 10 ends the time correction processing.

On the other hand, if the value of the comparison counter h reaches the last value "A+α" with no data agreement obtained by the loop processing (Step S11~S14) mentioned above, then the control circuit 10 judges that the received data includes an error and shifts the time correction processing to the side of NO in the judgment processing at Step S13. When the time correction processing has shifted to the side of NO, the control circuit 10 first ascertains whether data reception has been performed by B times (for example, 3 times) in this time correction processing or not. If the answer of the ascertainment is NO, then the control circuit 10 stands by for a time for re-reception C (for example, 10 minutes) (Step S17), following which the control circuit 10 returns the time correction processing to Step S1 and repeats the time correction processing from the beginning again. On the other hand, if the answer of the ascertainment at Step S16 is YES, then the control circuit 10 performs the display of reception impossibility or the like on the display section 11 (Step S18) and shifts the time correction processing to error processing.

As described above, according to the electric wave clock 1 of the present embodiment, the time correction processing of the second correcting mode does not obtain the whole time code for one frame or for a plurality of frames, but obtains only the data in a partial period of the frame or the plurality of frames to enable the setting of the timing data of the timer circuit 15 to the present time. Consequently, it is possible to shorten the operation period of the electric wave receiving IC 20 to attain the reduction of the electric power consumption required for the time correction.

That is, since a general electronic clock has the accuracy of the daily error of the degree of ±0.5 seconds or less, if the year, month, day, hour, minute, and second of the general electronic clock is once set, then the general electric clock does not get out of order in the levels of an hour and a minute for a long period, and the pulse arrangement of a specific range of a received time code can be consequently estimated. Thus it becomes possible to correct time (second data) by obtaining only the received data in a partial period estimated to include the partial data of the specific range and by judging in which timing of the received data the partial data exists. That is, the time of the reception processing necessary for a time correction is shortened, and the electric power consumption consumed in the time correction can be decreased by a large margin.

For example, the time charts of FIGS. 2A~2D show the case of executing the time correction processing in the case where a long period (for 30 days) has elapsed after the last time correction, and the time charts show that it is possible to perform the time correction only by obtaining the received data for 42 seconds. If not a so long time period has elapsed from the last time correction, then the period of the data reception can be shortened furthermore (for example, it is sufficient to obtain the received data for 14 seconds if a time correction is carried out at the time of elapsing 2 days from the last time correction), and the reduction quantity of the electric power consumption becomes larger by just that much.

Moreover, since the aforesaid embodiment calculates the maximum error time A of the timer circuit 15 on the basis of the time period from the last time correction to the present time correction processing and adds the calculated maximum error time A to the period in which the partial data D1 is transmitted to set a data obtainment period, the optimization of the data obtainment period is achieved.

Moreover, in the aforesaid embodiment, since the part of the year data, in which not so much changes of data arise, is selected as the partial data D1 in the specific range, for example, it is also possible not to perform the generation of the partial data D1 every time correction processing, but to store the partial data D1 into the storage section 12 or the like after once performing the generation of the partial data D1 and to divert the stored partial data D1 in a plurality of times of time correction processing.

Incidentally, although the processing pertaining to the second synchronization correction (the correction, of the 0.0 second point) is first executed in the processing at Steps S4~S6 in the time correction processing of the second correcting mode in the flow chart of FIG. 3, the processing of the second synchronization correction may be omitted, or may be executed separately at different timing. Moreover, although the timing of starting the operation of the electric wave receiving IC 20 is not especially restricted in the time correction processing of the aforesaid embodiment as shown in Step S3 of FIG. 3, it is also possible to make the operation period of the electric wave receiving IC 20 shortest to reduce the electric power consumption furthermore by setting the starting timing to the timing corresponding to the set value of the data obtainment starting time St (second). Incidentally, if the electric wave receiving IC 20 requires a predetermined time from a start of its operation to the stabilization of the reception operation, then it is preferable to consider the predetermined time to start the operation of the electric wave receiving IC 20 at a timing sooner than the data obtainment starting time St by the predetermined time.

Moreover, although the flow chart of FIG. 3 shows the example of repeating the comparison processing by shifting the comparison position of the partial data D1 from the head of the received data to the subsequent stage second by second at the time of searching for the position of the partial data D1 in the received data by the data matching processing, the method of shifting the comparison position can be changed to other various methods. For example, it is also possible to perform the data matching processing by shifting the comparison position in the order of alternately changing the sign of the value of the comparison counter h such as "0"→"1"→"−1"→"2"→"−2," and so forth.

Moreover, although the first embodiment shows the example of adopting the partial data D1 (the data in the range of from 40 seconds to 50 seconds of a time code) surrounding the year data, the data value of which does not change so much, as the partial data in the specific range to be compared with the received data, it is also possible to adopt the data in a division including the whole or a half of total day data or a division including hour data as the partial data in the specific range besides the partial data D1.

Moreover, it is also possible to adopt the partial data in a range in which the data value frequently changes, such as minute data, as the partial data in the specific range. The reason of this is that the timer circuit 15 has counted the data values having no malfunctions of a year, a month, a day, an hour, and a minute, and that the control circuit 10 can consequently generate all of the pulse arrangements of the time code for one frame, which is received at each hour, on the basis of the data values of the timer circuit 15. That is, the control circuit 10 can also generate the pulse arrangement of a part of the minute data by its operation. Accordingly, the control circuit 10 obtains the received data of the time code in a partial period in which the minute data is estimated to be received, and performs the data matching processing of the received data and the partial data including the minute data generated by the operation. Thereby, the control circuit 10 can calculate the position of the partial data in the received data, and hereby the control circuit 10 can perform the second correction.

Second Embodiment

FIG. 4 is a flow chart showing the procedure of the time correction processing of a second embodiment.

The electronic clock of the second embodiment differs from that of the first embodiment only in a part of the time correction processing of the second correcting mode, and is the same as that of the first embodiment in the other parts thereof. Accordingly, the description of the same parts is omitted here.

The time correction processing of the second embodiment performs the obtainment of received data in a period of from the data obtainment starting time St (second) to the data obtainment ending time En (second) by a plurality of times (N times) and accumulates the plurality of times of received data to treat the accumulated received data as the received data in order to be able to perform accurate data judgment of a time code even if the electric wave condition thereof is bad Thereby, the time correction processing of the second embodiment removes the influences of noises and the like to enable an accurate time correction. In the flow chart of the time correction processing of FIG. 4, the processing of Steps S1~S8 and the processing of Steps S9~S18 are the same as those at Steps S1~18, respectively, of the first embodiment of FIG. 3.

In the time correction processing of the second embodiment, the control circuit 10 obtains the received data in the period of from the time St to the time En in the processing of Steps S1~S8 of and once stops the operation of the electric wave receiving IC 20 to perform the processing of the addition of the received data together (Step S21) and the processing of the ascertainment of the performance of N times of reception (Step S22). If the times of the performance of the reception are less than N times, then the control circuit 10 returns the time correction processing to the processing at Step S3 again, and the control circuit 10 makes the electric wave receiving IC 20 operate to obtain the received data in the period of from the time St to the time En. Here, the received electric waves (received signal waveforms) which are added to obtain accumulated data or the received electric waves which are added and averaged to obtain accumulated data can be used instead of the received data. Also, nudging results of the received data pulses, which are added to obtain accumulated data or a judging result of the received data pulses, which are added and averaged to obtain accumulated data can be used instead of the received data.

The processing of the addition of the received data together at Step S21 is, for example, the processing of performing the data sampling of a time code signal detected by the electric wave receiving IC 20 with the AD converter and performing the addition and averaging of the waveform data.

Since the received data in the period of from the data obtainment starting time St (second) to the data obtainment ending time En (second) is, for example, the surrounding data of year data, each of the pieces of received data obtained by a plurality of times of reception processing has almost the same pulse patterns. Moreover, the partial data of the received data that has been searched for by the data matching processing becomes completely the same pulse pattern as long as the partial data exists in a period that does not cross over a year.

Consequently, the waveform data accumulating the received data in the period of from the data obtainment starting time St (second) to the data obtainment ending time En (second) by N times can be obtained by the aforesaid addition processing, and consequently the accurate received data in which external noises and white noises are removed from the pulse pattern of the received data of one time can be obtained. For example, if the processing of adding the received data of 10 times together is performed, then the signal level of the added received data becomes 10 times of that of the original received data, and, on the other hand, if the noises are supposed to be random, then the noise level of the accumulated received data becomes the root-mean-square value of the noise level of the not-accumulated received data. Consequently, the data of the addition of received data together by 10 times is the data having the S/N ratio improved by the square root of 10, that is, the data having the sensitivity improved by 10 dB. If the processing of the addition of received data together by 100 times is performed, the data having the sensitivity improved by 20 dB can be obtained similarly.

Then, when the control circuit 10 has obtained the received data having high sensitivity in the period of from the data obtainment starting time St (second) to the data obtainment ending time En (second) by the aforesaid plurality of times of data reception and the addition processing of the obtained pieces of received data together, the control circuit 10 shifts the time correction processing to Step S9 and performs the comparison processing of the partial data D1 and the received data similarly to the time correction processing of the first embodiment (Steps S10~15). Thereby the error time of the 0 second point of the timer circuit 15 can be detected, and the correction of the second data of the timer circuit 15 is performed.

As described above, since the electric wave clock 1 of the second embodiment performs the plurality of times of data reception in the predetermined period (the period of from the time St to the time En) and adds the respective pieces of received data together to generate the received data for data comparison, the S/N ratio of the received data for data comparison is improved, and an accurate time correction can be performed even when the electric wave condition of the electric wave clock is bad.

Incidentally, the addition processing of the received data together at Step S21 in FIG. 4 is not restricted to the processing of adding and averaging signal waveform data as described above, but, for example, the addition processing may be the processing accumulating the data as a result of the judgment of the pulse kind of received data by N times of the received data. For example, it is also possible to generate the data of accumulating N times of received data by judging the pulse kind of each data pulse of the received data with the control circuit 10 once, quantifying the judgment result by means of the values proportional to the pulse widths or the like (for example, "0.2" in case of the marker pulse M and the position marker pulse P, "0.5" in case of the data pulse of 1, and "0.8" in case of the data pulse of 0), and by adding and averaging the numerical values. Also by such an accumulation method of the received data, it is possible to obtain accurate received data with the influences of noises excluded even when the electric wave condition of the electric wave clock is bad.

Moreover, although the time correction processing of FIG. 4 adopts the partial data surrounding year data (the data of the time code in the range of from 40 seconds to 50 seconds), the data value of which does not change so much, as the partial data D1 in the specific range that is compared with received data, for example, it is also possible to adopt minute data of one minute digit, the data value of which changes periodically, as the partial data in the specific range. Next, a description will be given to a method of the addition processing of received data in the case of adopting the minute data of the one minute digit as the partial data in the specific range.

FIG. 5 shows a chart expressing the data values of minute data of a time code for continuous 60 frames.

The kind of each data pulse in the range of the time code from a 0 second point to 9 second point changes in the period (one hour) of continuous 60 frames as shown in the diagram of FIG. 5. That is, the data pulses of the 0 second point and the 9 second point are fixed to be the marker pulse M and the position marker pulse P, respectively; the data of a 10 minute digit is expressed by the data from 1 second point to 4 second point; and the data of a 1 minute digit is expressed by the data from 5 second point to 8 second point. Since the data of the 1 minute digit takes the same value every 10 minute, the arrangement of each data pulse at the 5 second point to the 8 second point becomes equal every interval of 10 frames.

Accordingly, if the data in the range including the minute data of 1 minute digit (for example, the range of the time code from the 5 second point to the 9 second point or the range of from 4 second point to 14 second point including the added unchanged data of at the surrounding positions of the former range) is adopted as the partial data in the specific range, then, for example, it is possible to generate the received data of a comparison object by performing the data reception for a plurality of frames in a period (for example, 10 minute period) in which each pulse kind of the partial data takes the same value, such as the partial data Y1 in the 7th frame of FIG. 5, the partial data Y2 in the 17th frame, the partial data Y3 in the 27th frame, . . . , and the partial data Y10 in the 57th frame, and by adding these pieces of received data together. Hereby, the advantages of the addition processing (Step S21) mentioned above can be similarly obtained.

Incidentally, the present invention is not restricted to the first and second embodiments described above, but various modifications can be performed. For example, although the electric wave clock 1 incorporating the electric wave receiving function therein has been described in the aforesaid embodiments, the present invention can similarly be applied to an electric wave receiving apparatus having no clock display function, and an electric wave receiving unit for being incorporated in a clock.

Moreover, even if the time codes and the formats of their data pulses are different from one another in various countries as shown in the explanatory diagrams of the data pulses constituting the time codes of the various countries in FIGS. 7A~7E, the present invention can similarly be applied to the time codes and the formats of the data pulses according to the formats of the various countries FIGS. 7A-7E show the kinds of the data pulses of Japan, the US, Germany, Switzerland, and UK, respectively. Moreover, a data frame for 60 seconds starting from a marker pulse M as its starting point is generally defined as one frame of a time code, a data frame for 60 seconds starting from an arbitrary point as its starting point may be defined as one frame of a time code in this description. That is, the data in a range of a time code, for example, from 55 second point to 5 second point, which range crosses over the marker pulse M, may be adopts as the partial data in the specific range.

In addition, the detailed configurations and methods shown in the embodiments described above can be suitably changed without departing from the spirit and scope of the present invention.

What is claimed is:

1. An electric wave clock comprising:

an error time calculating section which calculates an error time to be caused in timing data based on a time difference from a time point of a last correction of the timing data to a present time, when a time becomes a set time determined in advance, or a predetermined operation input is performed and a time correction is required;

a reception section which receives an electric wave and which demodulates the received electric wave to obtain a time code;

a control section which obtains received data from the reception section in a period obtained by adding the error time and a partial period which is supposed to include partial data in a specific range of the time code in a transmission period of one frame of the time code;

a comparison section which makes a comparison between the received data obtained in the period obtained by adding the error time and the partial period and the partial data in the specific range which is supposed to be received in the partial period;

a judgment section which judges in which timing in the period obtained by adding the error time and the partial period the partial data has been received by the comparison of the comparison section;

a timer section which times a time; and a data correction section which corrects the timing data of the timer section based on the timing judged by the judgment section.

2. The electric wave clock according to claim 1, wherein the timer section times a second time, and the data correcting section corrects the second time timed by the timer section based on the timing judged by the judgment section.

* * * * *